US008503168B2

(12) United States Patent
Souda et al.

(10) Patent No.: US 8,503,168 B2
(45) Date of Patent: Aug. 6, 2013

(54) IMAGE FORMING APPARATUS

(75) Inventors: Makoto Souda, Nagoya (JP); Tsuyoshi Iwamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 12/893,606

(22) Filed: Sep. 29, 2010

(65) Prior Publication Data

US 2011/0102983 A1 May 5, 2011

(30) Foreign Application Priority Data

Oct. 29, 2009 (JP) ..... 2009-249282
May 12, 2010 (JP) ..... 2010-110137

(51) Int. Cl.
*H05K 5/00* (2006.01)
*H05K 7/00* (2006.01)

(52) U.S. Cl.
USPC ..... 361/679.01; 361/679.02

(58) Field of Classification Search
USPC ..... 361/679.01, 679.02; 399/107; 355/133
See application file for complete search history.

(56) References Cited

U.S. PATENT DOCUMENTS

| | | | |
|---|---|---|---|
| 4,748,481 | A | 5/1988 | Kunihiro |
| 5,206,681 | A | 4/1993 | Otomo et al. |
| 2008/0002341 | A1 | 1/2008 | Tomatsu |
| 2010/0014887 | A1 | 1/2010 | Tomatsu et al. |
| 2010/0019443 | A1 | 1/2010 | Ichikawa |

FOREIGN PATENT DOCUMENTS

| | | | |
|---|---|---|---|
| JP | 2000-330351 | A | 11/2000 |
| JP | 2001-166550 | A | 6/2001 |
| JP | 2002-287452 | A | 10/2002 |
| JP | 2003-205649 | A | 7/2003 |
| JP | 2003-307894 | A | 10/2003 |
| JP | 2006-243749 | A | 9/2006 |

OTHER PUBLICATIONS

State Intellectual Property Office of the People's Republic of China, The First Office Action for Chinese Patent Application No. 201010538386.3 (counterpart to above-captioned patent application), mailed Apr. 18, 2012.

State Intellectual Property Office of the People's Republic of China, The Second Office Action for Chinese Patent Application No. 201010538386.3 (counterpart Chinese patent application), mailed Oct. 23, 2012.

Japan Patent Office, Notice of Reasons for Rejection in counterpart Japanese Patent Application No. 2009-249282, mailed Jun. 4, 2013.

*Primary Examiner* — Anthony Haughton
(74) *Attorney, Agent, or Firm* — Baker Botts L.L.P.

(57) ABSTRACT

An image forming apparatus includes a first right frame, a first left frame facing the first right frame, a second right frame positioned below the first right frame, a second left frame facing the second right frame and positioned below the second right frame. The image forming apparatus further includes an image forming unit positioned between the first right frame and the first left frame. The image forming apparatus still further includes a frame connecting unit configured to connect the first right frame, the first left frame, the second right frame and the second left frame. The first right frame and the second right frame are relatively slidable in an up-down direction, and the first left frame and the second left frame are relatively slidable in the up-down direction.

16 Claims, 10 Drawing Sheets

IMAGE FORMING APPARATUS

CROSS REFERENCE TO RELATED APPLICATION

The present application claims priority from Japanese Patent Applications No. 2009-249282, which was filed on Oct. 29, 2009, and No. 2010-110137, which was filed on May 12, 2010, the disclosures of which are incorporated herein by reference in their entirety.

BACKGROUND

1. Field of the Invention

The present invention relates to an image forming apparatus which includes an image forming unit for forming an image on a recording medium. More particularly, the invention relates to a frame structure of the image forming apparatus for supporting the image forming unit.

2. Description of the Related Art

An image forming apparatus in which an image forming unit is supported by frames is known. The image forming unit is supported by an upper frame, and the upper frame is supported from below by a lower frame.

Since the upper frame is placed on the lower frame in the image forming apparatus, when external force is applied on the image forming apparatus, a connecting portion of the upper frame and the lower frame may deform and the entire frame may deform into a parallelogram shape.

SUMMARY

A need has arisen to provide an image forming apparatus which reduces deformation of the entire frame due to external force by connecting the upper frame and the lower frame each other via a connecting unit and may enhance positional accuracy of components of the image forming unit.

According to an embodiment of the present invention, an image forming apparatus includes a first right frame, a first left frame facing the first right frame, a second right frame positioned below the first right frame, a second left frame facing the second right frame and positioned below the second right frame. The image forming apparatus further includes an image forming unit positioned between the first right frame and the first left frame. The image forming apparatus still further includes a frame connecting unit configured to connect the first right frame, the first left frame, the second right frame and the second left frame. The first right frame and the second right frame are relatively slidable in an up-down direction, and the first left frame and the second left frame are relatively slidable in the up-down direction.

In specifications, claims and drawings, in order to make easier to understand the invention, directions of "front", "rear", "left" and "right" are used. But "front" and "rear", and "left" and "right" may be subjectively determined depending on which side is considered as a front side, and "front" and "rear", and "left" and "right" can be exchanged by changing the front side. Thus, the embodiments and claims described therein-after further discloses an image forming apparatus in which "left" and "right", and "front" and "rear" in the embodiments and the claims are exchanged, and the exchanged image forming apparatus should be within the scope of the claims.

DESCRIPTION OF THE PREFERRED EMBODIMENTS

Overall Structure of Laser Printer

Figure 1:
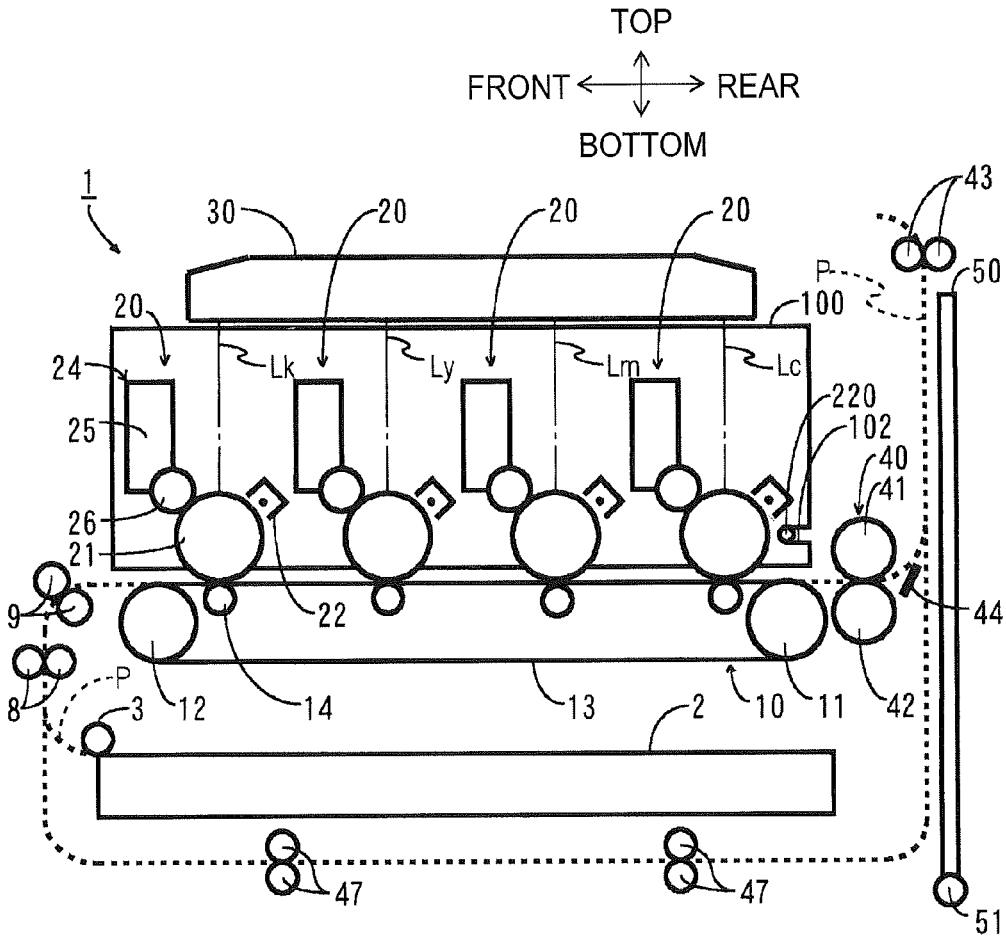
FIG. 1 is a schematic diagram illustrating a structure of a laser printer to which the invention is applied.

A laser printer 1, which is an embodiment to which the present invention is applied, will be described with reference to the drawings. The laser printer 1 is an example of an image forming apparatus. The laser printer 1 is a tandem color printer in which images are transferred directly to a recording medium from a photosensitive member. A paper feed tray 2 accommodating paper sheets P, which are exemplary recording media, is provided at a lower portion of the laser printer 1 so as to be pulled out to the front. A feed roller 3 for conveying the paper sheets P is provided at an upper front end of the paper feed tray 2. The feed roller 3 is adapted to convey the paper sheets P one at a time toward a pair of conveyor rollers 8, which will be described later. The pair of conveyor rollers 8 convey the paper sheet P toward resist rollers 9. The resist rollers 9 proceed the paper sheet P, fed from the feed roller 3 via the conveyor rollers 8, to an image forming unit.

Any existing processes, including a thermal process and an inkjet process, can be employed for the image forming unit. In the present embodiment, an electrophotographic process is employed as will be described below. The image forming unit includes a plurality of image forming sections, i.e., four process units 20 (an example of an image forming unit) for black (K), yellow (Y), magenta (M) and cyan (C), an exposure unit 30, a transfer unit 14, and a fixing unit 40.

Each of the process units 20 includes an electrostatic latent image carrier, i.e., a photosensitive member 21 (an example of an image forming section), a charging unit 22 and a development cartridge 24. The photosensitive member 21 may be belt- or drum-shaped. In the present embodiment, a drum-shaped photosensitive member (hereinafter, "photosensitive drum") is employed. The photosensitive drum 21 is constituted by a grounded metal drum body covered with a positively-chargeable photosensitive layer.

The charging unit 22 is disposed to oppose, at a back obliquely upward position of, and at a certain distance from, the photosensitive drum 21. In the present embodiment, the charging unit 22 is a scorotron type which causes corona discharge from a charging wire and charges a surface of the photosensitive drum 21 positively and uniformly. The development cartridge 24 accommodates a toner container 25 which receives a positively-chargeable nonmagnetic one-component developing agent, i.e., toner, of black, yellow, magenta or cyan. The toner is positively charged by friction and supplied to the photosensitive drum 21 via a developing roller 26.

The exposure unit 30 is disposed over the process units 20. The exposure unit 30 may employ existing light sources, including LED and laser light. The present embodiment employs laser light. The exposure unit 30 includes semiconductor parts (not illustrated) for generating laser light L (Lk, Ly, Lm, and Lc) corresponding to image data of each color and polygon mirrors (not illustrated) for deflecting the laser light L (Lk, Ly, Lm and Lc). The exposure unit 30 scan-exposes the photosensitive drums 21.

The plural process units 20 are arranged in substantially a flat manner with the photosensitive drums 21 disposed parallel to one another. A belt unit 10 is disposed below and in parallel with the arranged process units 20. The belt unit 10 includes an endless conveyor belt (i.e., a transfer belt) 13 spanned between a driving roller 11 and a follower roller 12. The belt unit 10 conveys the paper sheet P fed from the resist rollers 9 in the arrangement direction of the photosensitive drums 21 in a manner such that the paper sheet P on the conveyor belt 13 contacts the photosensitive drums 21.

The belt unit 10 includes a transfer unit 14 constituted by four rollers disposed opposite to the photosensitive drums 21 via the conveyor belt 13.

In operation, surfaces of the photosensitive drums 21 are charged positively and uniformly by corresponding charging unit 22 as the photosensitive drums 21 begin to rotate. The surfaces are exposed by high-speed scanning of the laser light L emitted from the exposure unit 30 and electrostatic latent images corresponding to an image to be transferred to the paper sheet P are formed on the photosensitive drums 21. Then, as the developing rollers 26 rotate, the positively-charged toner carried on the developing rollers 26 is brought into contact with the photosensitive drums 21 and is supplied to the electrostatic latent images formed on the surfaces of the photosensitive drums 21. Toner images corresponding to the electrostatic latent images are now carried on the surfaces of the photosensitive drums 21.

The toner images carried on the surfaces of the photosensitive drums 21 are sequentially transferred to the paper sheet P by a transfer bias current applied to the transfer rollers 14 when the paper sheet P conveyed by the conveyor belt 13 passes through the photosensitive drums 21 and the transfer units 14. The paper sheet P having the toner image transferred thereon is conveyed to the fixing unit 40 provided in the downstream of the belt unit 10.

The fixing unit 40 consists of a heat roller 41 and a pressure roller 42. The heat roller 41, including a heat source, such as a halogen lamp, is driven to rotate. The pressure roller 42 is disposed opposite to, and pressed against, the heat roller 41 so as to follow the rotation of the heat roller 41. In the fixing unit 40, as the paper sheet P with the toner image of four colors formed thereon is pinched and conveyed between the heat roller 41 and the pressure roller 42, the toner image is fixed by heat on the paper sheet P. The paper sheet P with the toner image is thermally fixed thereon is discharged by sheet discharge rollers 43 to a discharge tray (not illustrated) provided on the upper surface of the laser printer 1.

A flapper 44 is swingably provided between the fixing unit 40 and the sheet discharge rollers 43. The flapper 44 switches the conveying path of the paper sheet P between a path from the fixing unit 40 to the sheet discharge rollers 43 and a path from the sheet discharge rollers 43 to a plurality of pairs of re-transfer rollers 47. The re-transfer rollers 47 are provided below the paper feed tray 2 for the conveyance of the paper sheet P to the resist rollers 9.

For the printing on both sides of the paper sheet P, the flapper 44 is swung to direct the paper sheet P to the sheet discharge rollers 43 and the paper sheet P is conveyed upward as illustrated in FIG. 1 by the sheet discharge rollers 43 rotating in a forward direction. When a trailing end of the paper sheet P passed the flapper 44, the sheet discharge rollers 43 begin to rotate in a reverse direction and the flapper 44 is swung to direct the paper sheet P to the re-transfer rollers 47.

The paper sheet P is conveyed by the re-transfer rollers 47 with the trailing end first and is supplied in an inverted state to the surface of the conveyor belt 13 via the resist rollers 9. A toner image is transferred to the back surface of the paper sheet P in the manner described above and is then fixed by the fixing unit 40. The paper sheet P with the images formed on both sides is discharged via the sheet discharge rollers 43. A rear cover 50 is provided at the back of the laser printer 1. The rear cover 50 can be opened about a hinge 51. When disposed at a substantially upright position from the hinge 51, i.e., a closed position, as illustrated in FIG. 1, the rear cover 50 defines the conveying path of the paper sheet P from the flapper 44 to the sheet discharge rollers 43 and the conveying path of the paper sheet P from the sheet discharge rollers 43 to the re-transfer rollers 47 via the flapper 44.

Each of the process units 20 is removably accommodated in one of four storage sections (not illustrated) provided in a drum subunit 100. The drum subunit 100 is supported by a substantially box-shaped body frame 200 to be slidable in a front-rear direction. The drum subunit 100 can be pulled out through an opening in a front side (i.e., a side opposite to the rear cover 50) of an outer case (not illustrated) of the body frame 200. In the present embodiment, directions will be defined as follows: the direction in which the drum subunit 100 is pulled out is defined as a front direction; the direction in which the drum subunit 100 is retracted to the outer case is defined as a back direction; a horizontal direction perpendicular to the front-rear direction is defined as a left-right direction; and a vertical direction perpendicular to the front-rear direction is defined as a vertical direction.

[Body Frame Structure]

Figure 2:
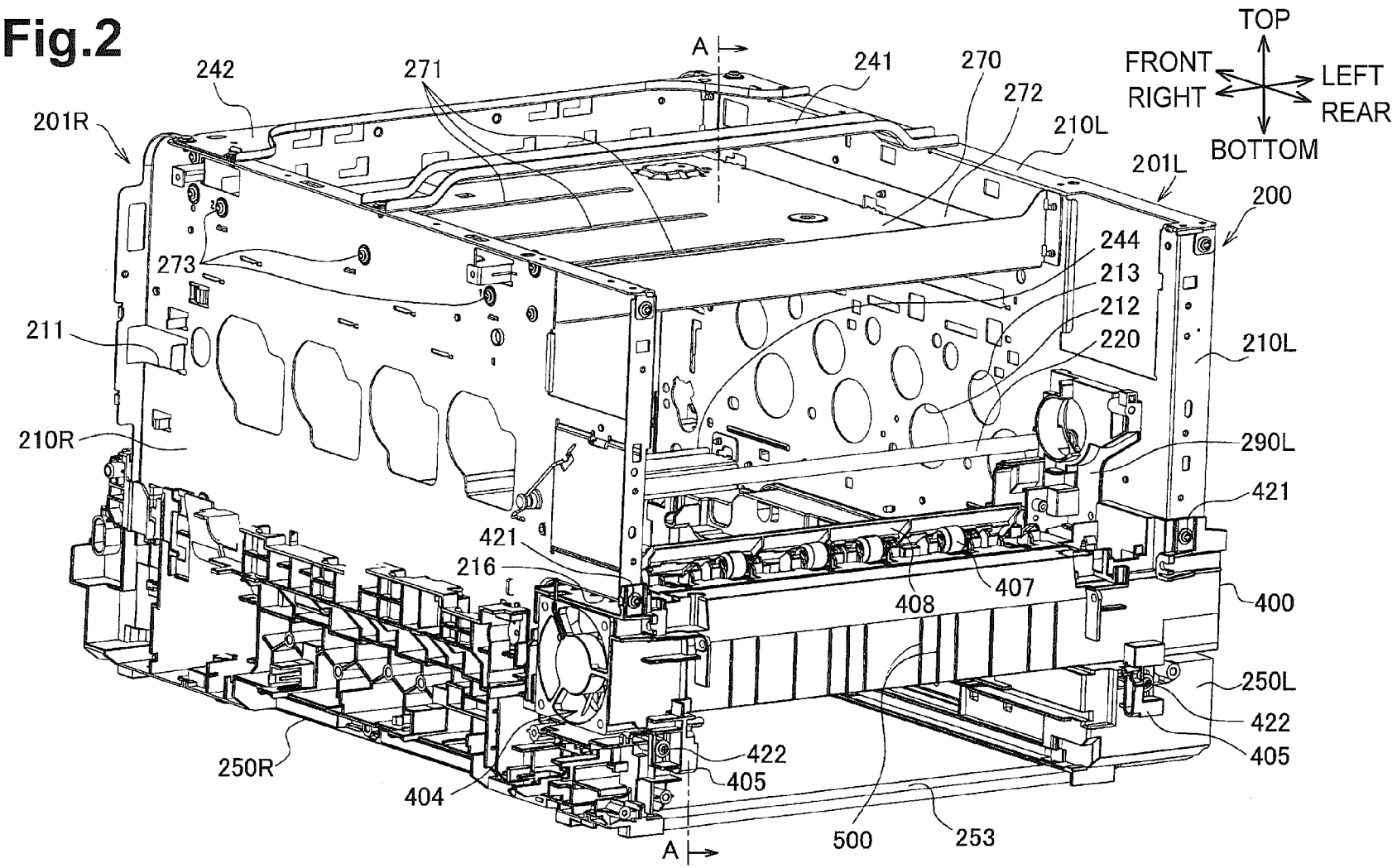
FIG. 2 is a perspective view of a body frame structure of the laser printer seen from an upper back right side with an image forming unit removed.

As illustrated in FIG. 2, the body frame 200 includes a pair of left and right frames 201L and 201R, upper frame connecting units 241, 242 and 270 (an example of an upper frame connecting unit), bottom frame connecting units 252 and 253 (an example of a lower frame connecting unit) and frame connecting unit 400. The left and right frames 201L and 201R oppose each other with the image forming unit disposed therebetween. The upper frame connecting units 241, 242 and 270 connect upper ends of the frames 201L and 201R. The bottom frame connecting units 252 and 253 connect lower ends of the frames 201L and 201R. The frame connecting unit 400 (an example of a frame connecting unit) connects rear ends of the frames 201L and 201R between the upper frame connecting unit and the bottom frame connecting unit.

Each of the frames 201L and 201R is constituted by an upper and a lower components: a pair of first frames 210L (an example of a first left frame) and 210R (an example of a first right frame) made of sheet metal (hereinafter "sheet metal frames"); and a pair of second frames 250L (an example of a second left frame) and 250R (an example of a second right frame) made of resin (hereinafter "resin frames") which support the sheet metal frames 210L and 210R from below. The sheet metal frames 210L and 210R oppose each other with the image forming unit disposed therebetween and extend along vertical and horizontal directions (i.e., front-rear direction) along planes perpendicular to a plane along which the sheet metal frames 210L and 210R oppose each other. The sheet metal frames 210L and 210R are highly rigid along the planes they extend. Top, front and rear edges of the sheet metal frames 210L and 210R are bent outward at a right angle to provide certain rigidity against force to twist the above-described planes.

The resin frames 250L and 250R each has a longitudinal wall extending in the vertical and front-rear directions, of which top, bottom, and front and rear edges are bent outward at a right angle. Thus the resin frames 250L and 250R have U-shaped cross sections. Although they are made of resin materials, the resin frames 250L and 250R can realize certain rigidity with this geometrical configuration, however, vertical rigidity thereof is lower than that of the sheet metal frames 210L and 210R. The resin frames 250L and 250R support the paper feed tray 2 and the re-transfer rollers 47 therebetween.

The drum subunit 100 is supported by rail members provided in opposing inner surfaces of the sheet metal frames 210L and 210R so as to be slidable in the front-rear direction. As illustrated in FIG. 1, a cutout 102 is formed toward the front direction at a lower rear end of the drum subunit 100. At the time of mounting the drum subunit 100 to the body frame 200, the cutout 102 receives a main body reference axis 220 (see FIG. 2) extending between the sheet metal frames 210L and 210R. Thus the rear end of the drum subunit 100 is positioned in the vertical and front-rear directions. Shafts (not illustrated) protruding outward in the left-right direction are provided at the front end of the drum subunit 100. The sheet metal frames 210L and 210R includes openings 211 (only one of them formed in the sheet metal frame 210R is illustrated in FIG. 2) for receiving the shafts.

One of the upper frame connecting units 270 is fixed to upper ends of the sheet metal frames 210L and 210R in the following manner. As illustrated in FIG. 2, left and right bent edges 272 of the upper frame connecting units are fixed to the upper ends of the sheet metal frames 210L and 210R each in three places along the front-rear direction with screws 273. The connecting unit 270 is an example of an exposure unit plate which supports the exposure unit 30. The connecting unit 270 has four slits 271 (only three slits 271 are illustrated in FIG. 2) which allow laser light L corresponding to each color to pass through.

Other upper frame connecting units, i.e., an upper beam 241 and a front beam 242, each connects the upper ends of the sheet metal frames 210L and 210R at an upper central portion of the exposure unit 30 and the upper front ends of the sheet metal frames 210L and 210R. The upper beam 241 and the front beam 242 increase rigidity of the sheet metal frames 210L and 210R near the exposure unit 30. A metal under beam 244 connects the sheet metal frames 210L and 210R at their lower front portions.

The bottom frame connecting units 252 and 253 connect lower surfaces of the resin frames 250L and 250R in two places spaced apart in the front-rear direction. As will be described later, the frame connecting unit 400 is fixed to, and extends between, the lower ends of the sheet metal frames 210L and 210R and the upper ends of the resin frames 250L and 250R. Accordingly, the sheet metal frames 210L and 210R are formed as a frame constituted by the upper frame connecting units 241 and 242, the under beam 244, and the frame connecting unit 400 when seen from the front-rear direction. The resin frames 250L and 250R are formed as a frame constituted by the bottom frame connecting units 252 and 253 and the frame connecting unit 400 when seen from the front-rear direction.

The left sheet metal frame 210L includes round holes 212 in which drive couplings (not illustrated) for driving the photosensitive drum 21 are inserted. The left sheet metal frame 210L also includes round holes 213 in which drive couplings (not illustrated) for driving the developing roller 26 are inserted. A drive system (not illustrated) for driving the drive couplings by a motor is fixed to an outer side of the left sheet metal frame 210L.

The feed roller 3, the conveyor rollers 8, and the resist rollers 9 are accommodated in a unit box provided between lower front portions of the sheet metal frames 210L and 210R. The fixing unit 40 is attached to mounting members 290L and 290R fixed to the opposing inner surfaces of the sheet metal frames 210L and 210R. The fixing unit 40 can be removed from the back side of the sheet metal frames 210L and 210R. The belt unit 10 is attached between lower portions of the sheet metal frames 210L and 210R. Alternatively, the belt unit 10 may be attached to the mounting members 290L and 290R.

Figure 3:
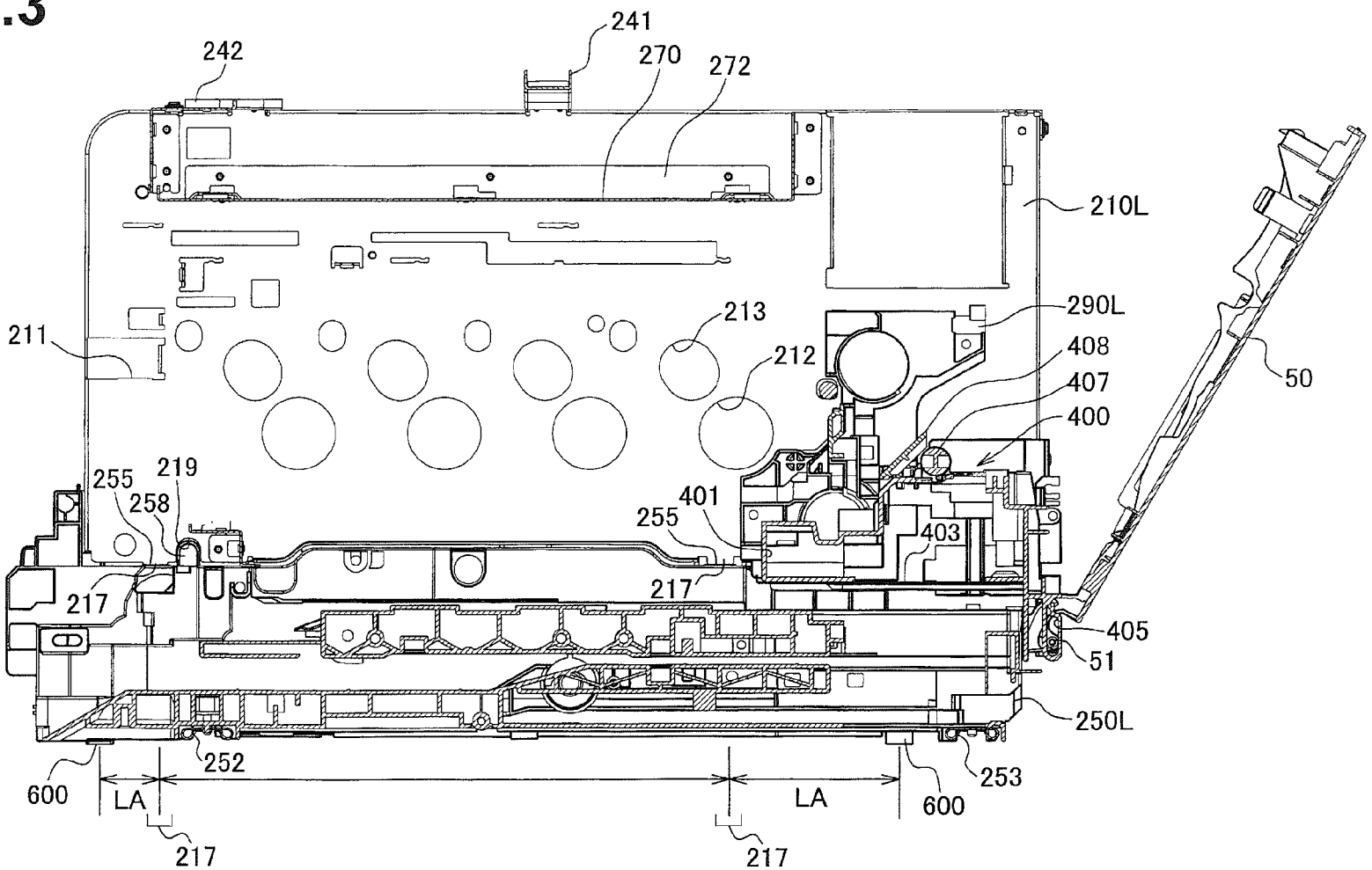
FIG. 3 is a cross-sectional view taken along line A-A of FIG. 2.
Figure 4:
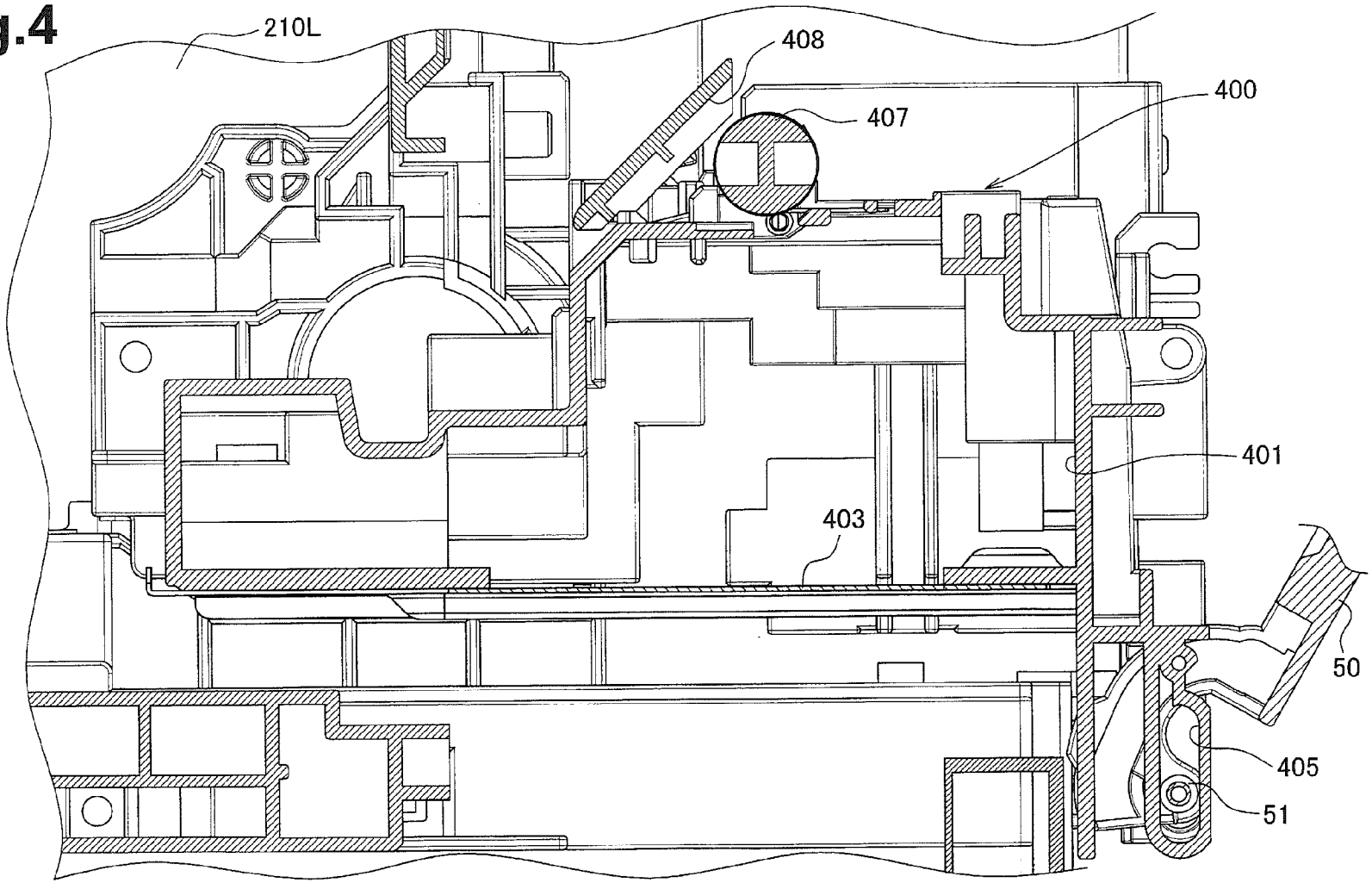
FIG. 4 is a partially enlarged sectional view of FIG. 3.

As illustrated in FIGS. 3 and 4, the power supply unit 400 is mounted to the sheet metal frames 210L and 210R at a lower back position of the fixing unit 40. The power supply unit 400 is also an example of a frame connecting unit which connects rear ends of the frames 201L and 201R. As illustrated in FIG. 4, the power supply unit 400 is provided with a resin-made cylindrical duct 401 extending in the left-right direction. A substrate 403 which supplies electric power for driving the motor or other components is provided on a lower surface of the duct 401. Power supply components and the like mounted on the substrate 403 are not illustrated in FIGS. 3 and 4. As illustrated in FIG. 2, a fan 404 is provided at the right end of the power supply unit 400 to discharge air in the duct 401 out of the laser printer 1 and cool the substrate 403.

A bearing 405 is formed integrally with the duct 401 at a lower rear end of the power supply unit 400. The bearing 405 supports the hinge 51 of the rear cover 50 to be rotatable and movable in the vertical direction. A guide 408, which is not illustrated in FIG. 1, and a plurality of cleaner rollers 407 are provided in the upper portion of the power supply unit 400. The guide 408 guides the paper sheet P toward the fixing unit 40 from the conveyor belt 13. The cleaner rollers 407 remove residual toner from a surface of the pressure roller 42. The cleaner rollers 407 are arranged to correspond to a plurality of peeling pawls disposed at certain intervals along the width direction of the paper sheet P (i.e., the left-right direction). Each of the cleaner rollers 407 rotates in contact with the pressure roller 42. As illustrated in FIG. 2, a plurality of guide ribs 500 is integrally provided to protrude from the rear surface of the power supply unit 400. The guide ribs 500 extend in the vertical direction along a part of the conveying path of the paper sheet P to the re-transfer rollers 47 from the flapper 44 to help smooth conveyance of the paper sheet P.

A circular guide groove is formed in the rear cover 50 near the hinge 51 which receive a cylindrical pin (or a roller) provided near the bearing 405 of the power supply unit 400. When, for example, the rear cover 50 is opened, the cylindrical pin moves within the circular guide groove and thereby the hinge 51 of the rear cover 50 moves upward toward the upper end of the bearing 405. In contrast, when the rear cover 50 is closed, the cylindrical pin similarly moves within the circular guide groove and thereby the hinge 51 of the rear cover 50 moves downward toward the lower end of the bearing 405. This mechanism helps removal of jammed paper sheet P. When a paper jam occurs in the conveying path from the flapper 44 to the re-transfer rollers 47 in the process of forming images on both sides of the paper sheet P, the lower end of the rear cover 50 is displaced to open the conveying path as the rear cover 50 is opened, and thereby the jammed paper sheet P can be removed easily.

An upper surface of the opened rear cover 50 may be used as a face-up discharge tray for the paper sheet P discharged in a face-up manner (i.e., straight discharging) with an image formed at one side thereof. In this case, the rear cover 50 can be disposed at a position along the height direction further close to the paper sheet P discharged in a straight manner toward the back side. Thus loading efficiency of the paper sheets P (i.e., capability of loading the paper sheets P in an arranged manner) of the rear cover 50 can be improved.

[Connecting Structure of Sheet Metal Frames and Resin Frames]

Figure 9:
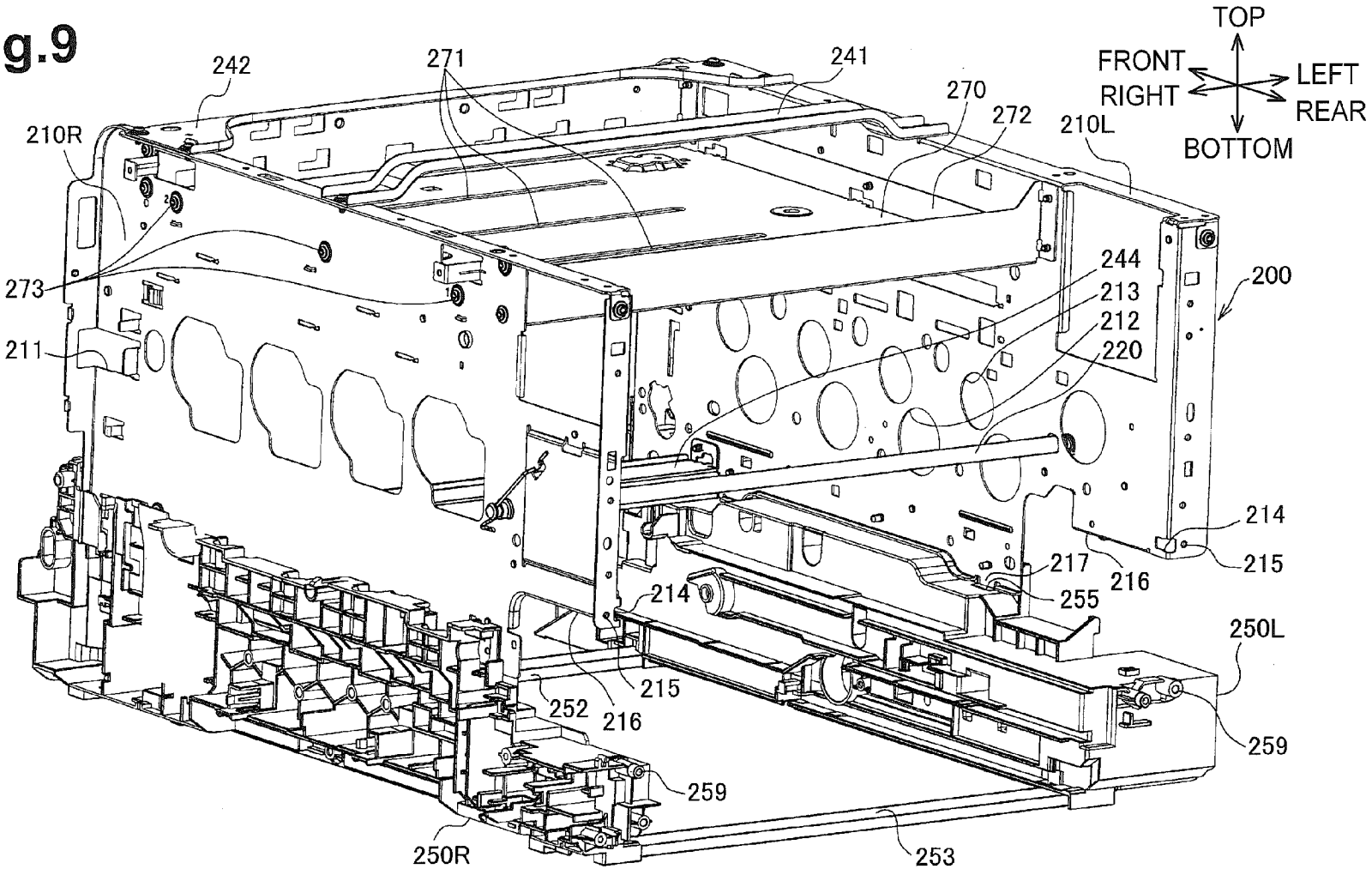
FIG. 9 is a perspective view of the body frame structure illustrated in FIG. 5 with the mounting members further removed.

As illustrated in FIGS. 3 and 9, bottom edges of the sheet metal frames 210L and 210R are bent inward except for certain portions. The portions which are not bent extend downward to be used as connecting pieces 217 for the connection with the resin frames 250L and 250R. That is, the rectangular-shaped connecting pieces 217 protrude downward from the sheet metal frames 210L and 210R in a plurality of places spaced apart in the front-rear direction and abut on rectangular parallelepiped rests 255 protruding from the upper surfaces of the resin frames 250L and 250R.

Inverted U-shaped cutouts 219 are formed at bottom front edges of the sheet metal frames 210L and 210R. Inverted U-shaped projections 258 are formed in the resin frames 250L and 250R at positions opposite to the cutouts 219. Abutment between the connecting pieces 217 and the rests 255 define positions of the sheet metal frames 210L and 210R with respect to the resin frames 250L and 250R along the height direction. Engagement between the cutouts 219 and the projections 258 define positions of the sheet metal frames 210L and 210R with respect to the resin frames 250L and 250R along the front-rear direction. Abutting portions of the connecting pieces 217 and the rests 255 are also connecting portions between the sheet metal frames 210L and 210R and the resin frames 250L and 250R so that load of the image forming unit and the sheet metal frames 210L and 210R is received by the resin frames 250L and 250R.

Figure 10:
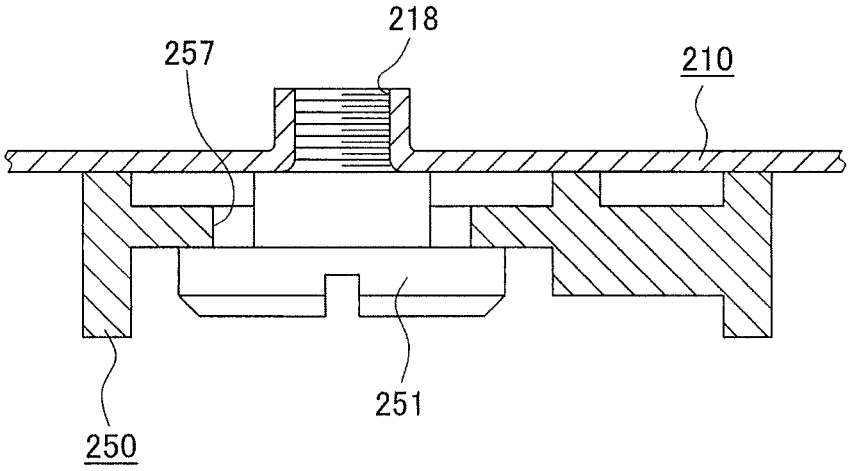
FIG. 10 is a cross-sectional view of main part illustrating a connection between the resin frame and the sheet metal frame.

The sheet metal frames 210L and 210R and the resin frames 250L and 250R are fixed together in two or more places with screws 251 (see FIG. 10) inserted in walls formed upright from the upper surfaces of the resin frames along side surfaces of the sheet metal frames. Fixation with the screws is relatively loose. For example, as illustrated in FIG. 10, a screw 251 is formed as a stepped screw. A screw hole 257 in the resin frame 250 is sufficiently larger than a stepped portion of the screw 251. A screw portion at the tip of the screw 251 is screwed into a screw hole 218 in the sheet metal frame 210.

The resin frame 250 and the sheet metal frame 210 are connected to each other by the screw 251 so loosely that relative displacement might occur between these frames. Thus there is no possibility that deformation of the resin frame 250 might be directly transmitted to the sheet metal frame 210. Even if the resin frame 250 and the sheet metal frame 210 have different coefficients of linear expansion, difference in dimension due to temperature change can be absorbed and thus there is no possibility of warping of the resin frame 250 and the sheet metal frame 210.

Although the screw 251 is a stepped screw in the foregoing description, similar effects can be provided by general screws used together with, for example, a washer to form a stepped portion. Other structures having similar effects may also be used.

Support legs 600 (an example of a leg, see FIG. 3) are provided to protrude downward from the lower surfaces of the resin frames 250L and 250R at positions near the front and rear ends. The support legs 600 contact the installation surface, such as a floor, on which the laser printer 1 is installed. The support legs 600 are provided further outward of the two front and rear connecting pieces 217 of the sheet metal frames 210L and 210R at a distance LA in the front-rear direction. That is, the resin frames 250L and 250R extend further outward in the front-rear direction than the connecting pieces 217 and have support legs 600 at the extended portions. Thus the extended portions can be elastically deformed in the vertical direction substantially about lower portions of the connecting pieces 217. Since the two front and back connecting pieces 217 are provided above and between the positions of the two front and back support legs 600, the sheet metal frames 210L and 210R including the image forming unit are supported by the resin frames 250L and 250R between the support legs 600 to have elasticity along the vertical direction.

[Power Supply Unit Mounting Structure in Body Frame]

Figure 5:
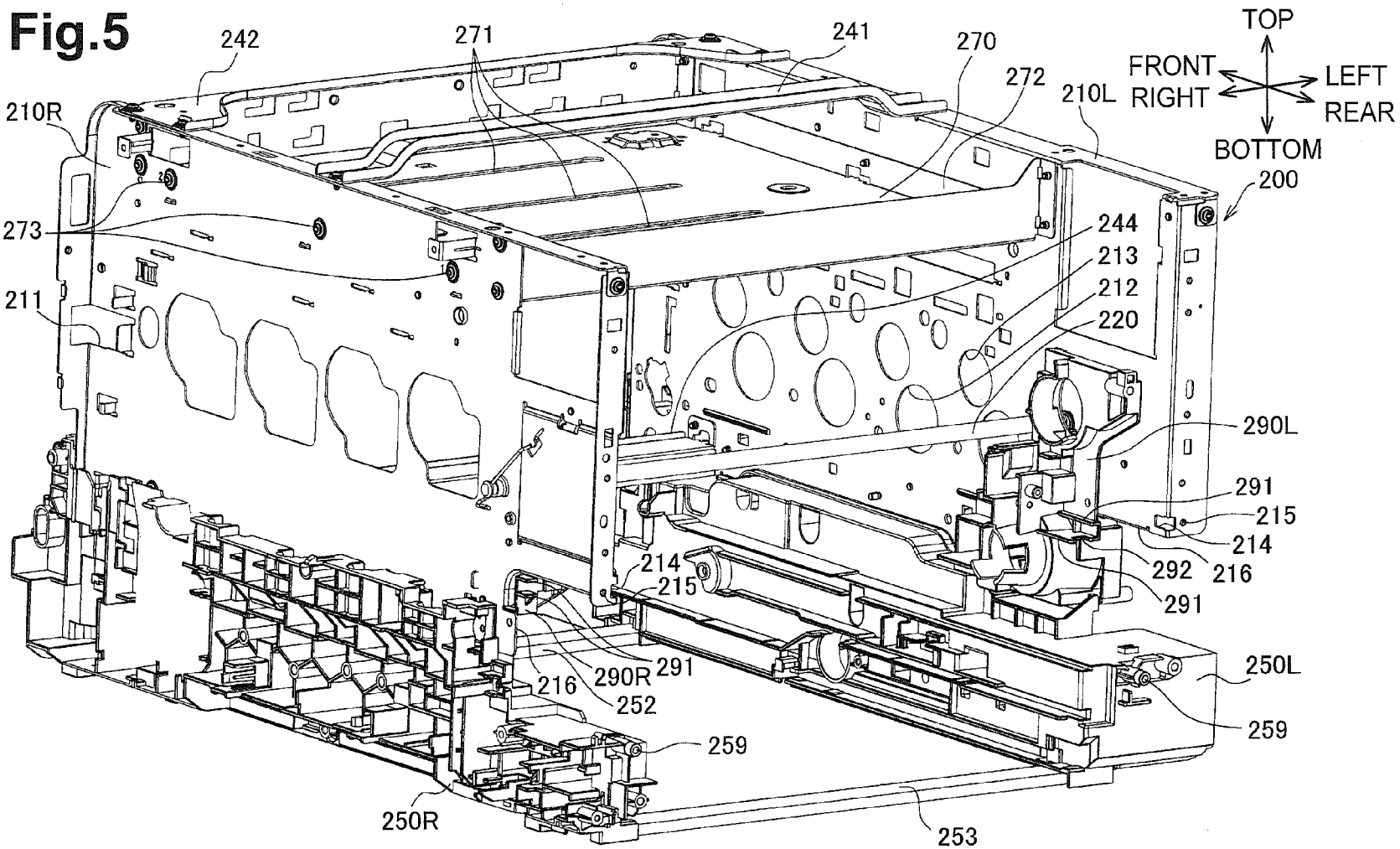
FIG. 5 is a perspective view of the body frame structure illustrated in FIG. 2 with a power supply unit further removed.
Figure 6A:
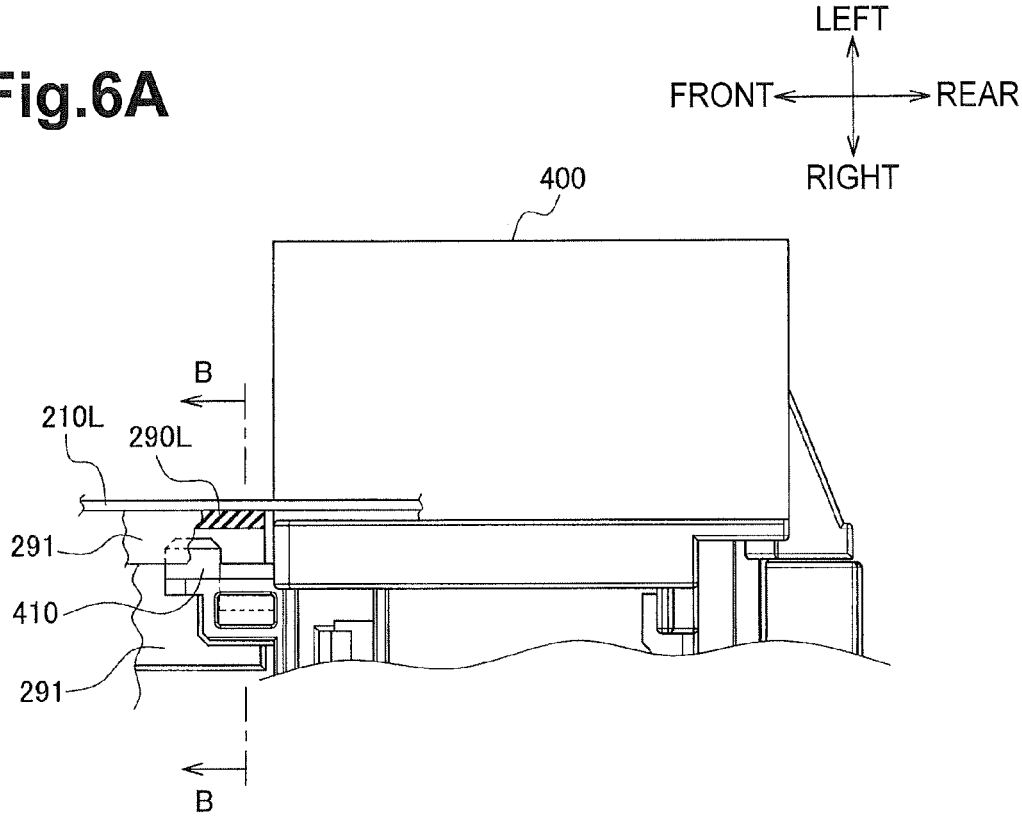
FIG. 6A is a plan view illustrating a connection between the power supply unit and a sheet metal frame.
Figure 6B:
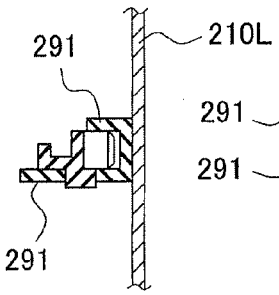
FIG. 6B is a cross-sectional view taken along line B-B of FIG. 6A.
Figure 6C:
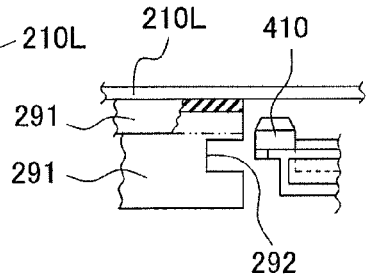
FIG. 6C is a plan view of FIG. 6A with a pin 410 removed.
Figure 6D:
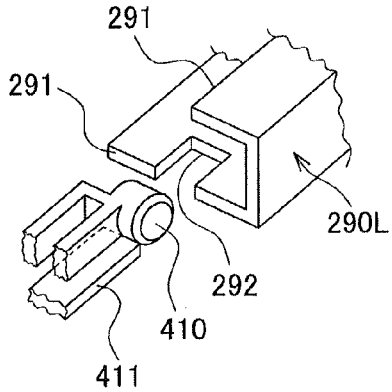
FIG. 6D is a perspective view of FIG. 6C.

The power supply unit 400 is fixed to vertically-extending rear end surfaces of the sheet metal frames 210L and 210R and the resin frames 250L and 250R in a manner such that ends of the power supply unit 400 substantially adjoin the rear end surfaces of the frames. As illustrated in FIGS. 2 and 5, the power supply unit 400 is positioned by a pair of resin-made mounting members 290L and 290R fixed to the opposing inner surfaces of the sheet metal frames 210L and 210R. As illustrated in FIG. 6, pins 410 are provided near left and right ends of the power supply unit 400 and a pair of upper and lower horizontal plates 291 for positioning the pins 410 in the vertical direction are provided to protrude from the mounting sections 290L and 290R. The horizontal plates 291 are formed as plates protruding horizontally inward from the mounting members 290L and 290R. One of the pins 410 can be horizontally inserted from the backside between the opposing horizontal plates 291 arranged in the vertical direction. In FIG. 6A, the upper horizontal plate 291 protruding from the mounting section 290L is partially cut away.

In the left mounting member 290L, the lower horizontal plate 291 is wider than the upper horizontal plate 291. A rectangular cutout 292 is formed in a rear end surface of the lower horizontal plate 291. A rectangular plate-shaped fitting section 411 which fits into the cutout 292 is formed integrally with the pin 410 at a lower rear position of the pin 410. With this structure, when the left pin 410 is inserted between the horizontal plates 291 protruding from the mounting member 290L, the fitting section 411 fits into the cutout 292 and thus the pin 410 is positioned in the left-right and front-rear directions.

Figure 7:
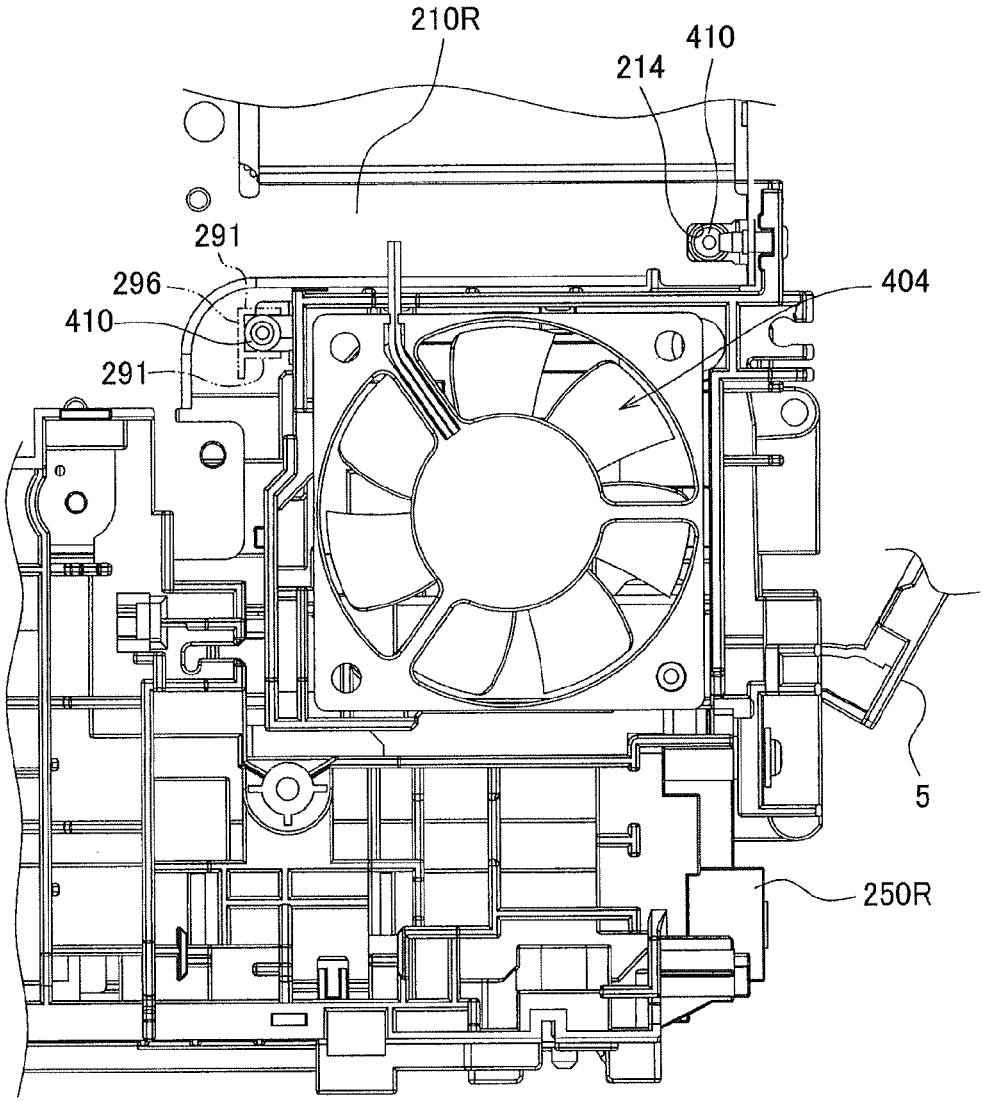
FIG. 7 is a right side view of FIG. 6A with mounting members not illustrated.

As illustrated in FIG. 7, front ends of the horizontal plates 291 provided to protrude from the right mounting section 290R are connected together with a connecting section 296 to form a U-shape when seen in a side view. A pin 410 is positioned in the front-rear direction by the abutment with the connecting section 296.

Such a pin 410 is provided in other places of the power supply unit 400. As illustrated in FIGS. 5 and 7, holes 214 are formed at rear ends of the sheet metal frames 210L and 210R which are bent outward at a right angle for receiving the pins 410 provided in other places. Bis holes 215 are provided at the bent rear ends of the sheet metal frames 210L and 210R for receiving the screws 421 (an example of a connecting member, see FIG. 2) for the fixation of the power supply unit 400.

Bosses 259 are provided to protrude in rear end surfaces of the resin frames 250L and 250R for receiving tapping screws 422 (an example of a connecting member, see FIG. 2) for the fixation of the power supply unit 400.

Hook-shaped cutouts 216 are formed to oppose each other in the rear ends of the sheet metal frames 210L and 210R at positions below the hole 214 and the screw hole 215. The cutouts 216 receive left and right end portions of the power supply unit 400. A detailed structure of the cutouts 216 is illustrated in FIG. 9 which illustrates a structure of the body frame 200 with the mounting sections 290L and 290R removed from the state of FIG. 5.

Figure 8A:
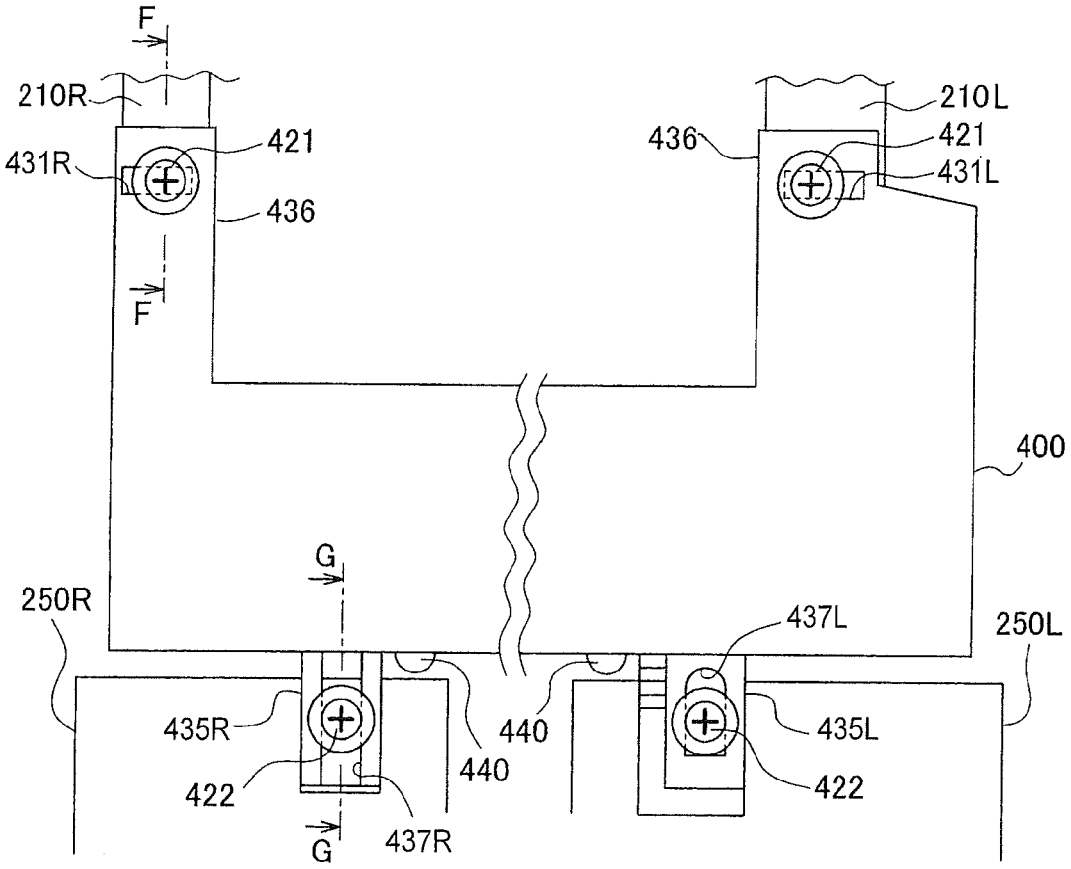
FIG. 8A is a rear view illustrating connections among the power supply unit, the sheet metal frame, and a resin frame.
Figure 8B:
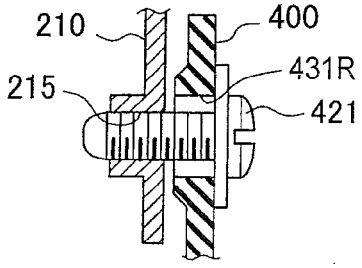
FIG. 8B is a cross-sectional view taken along line F-F of FIG. 8A.

As illustrated in FIG. 8A, a pair of mounting pieces 436 is provided to extend upward at the left and right ends of the power supply unit 400 and oblong holes 431L (an example of a first left oblong hole) and 431R (an example of a first right oblong hole) are formed in the mounting pieces 436 at positions opposite to the screw holes 215 in the sheet metal frames 210L and 210R. As illustrated in FIGS. 8A and 8B, the oblong holes 431L and 431R are larger than the thread of the screw 421 along the vertical and left-right directions. With this structure, the power supply unit 400 can be positioned with high accuracy irrespective of positional accuracy of the screw holes 215 and fixed to the sheet metal frames 210L and 210R as will be described below.

Gaps are designed to be left between the sheet metal frames 210L and 210R and the power supply unit 400 as illustrated in FIG. 8B after the fitting section 411 fit into the cutout 292 and the screw 421 is tightened until the pin 410 abuts the connecting section 296. Since the mounting pieces 436 are bent by the screws 421, the position of the power supply unit 400 along the front-rear direction is defined accurately by the cutouts 292 and the connecting sections 296. The rectangular cutouts 292 and the fitting sections 411 position the power supply unit 400 only in the left-right direction.

Figure 8C:
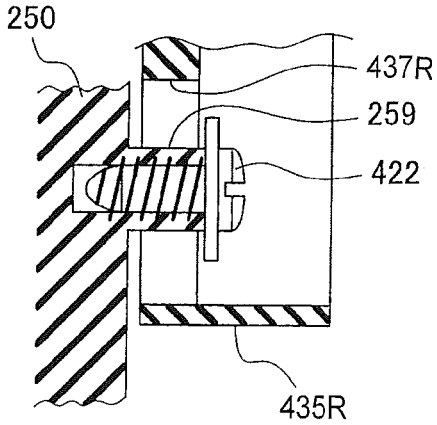
FIG. 8C is a cross-sectional view taken along line G-G of FIG. 8A.

A pair of rectangular mounting pieces 435L and 435R is provided to extend downward from the lower left and right ends of the power supply unit 400 at positions opposite to the rear end surfaces of the resin frames 250L and 250R. At positions where the mounting pieces 435L and 435R and the resin frames 250L and 250R oppose each other, oblong holes 437L (an example of a second left oblong hole) and 437R (an example of a second right oblong hole) are formed in each of the mounting pieces 435L and 435R and a boss 259 to fit into the oblong holes 437L and 437R are formed in each of the resin frames 250L and 250R. As illustrated in FIGS. 8A and 8C, the oblong holes 437L and 437R are larger than the boss 259 in the vertical direction and have a small gap with the boss 259 in the left-right direction to substantially limit relative movement of the oblong holes 437L and 437R and the boss 259. The oblong holes 437L and 437R are smaller than a flange of the tapping screw 422 along the left-right direction.

When the screws 421 are tightened as described above, gaps are designed to be formed between the resin frames 250L and 250R and the mounting pieces 435L and 435R, and gaps are also designed to be formed between the flanges of the tapping screws 422 tightened to the screw holes at the center of the bosses 259 and the mounting pieces 435L and 435R. Thus the connection between the resin frames 250L and 250R and the power supply unit 400 using the tapping screws 422 provides a degree of freedom in front-rear and vertical directions. The flanges of the tapping screws 422 reduce removal of the mounting pieces 435L and 435R out of the bosses 259.

The gap between the oblong holes 437L and 437R and the bosses 259 along the left-right direction are small and thus the position of the resin frames 250L and 250R along the left-right direction will be determined substantially by the oblong holes 437L and 437R. As described above, since the sheet metal frames 210L and 210R and the resin frames 250L and 250R, are loosely fixed together, relative positions of the sheet metal frames 210L and 210R, the resin frames 250L and 250R and the power supply unit 400 can be determined through adjustment of the positions of the resin frames 250L and 250R with respect to the sheet metal frames 210L and 210R.

Thus the power supply unit 400 is fixed to, and extends between, the left sheet metal frame 210L and the resin frame 250L at the left end thereof and between the right sheet metal frame 210R and the resin frame 250R at the right end thereof. Further, the power supply unit 400 connects the frames 201L and 201R. That is, the power supply unit 400 is an example of a frame connecting unit. Even if the sheet metal frames 210L and 210R and the resin frames 250L and 250R are loosely fixed together as described above, the power supply unit 400 reduces deformation of the entire device frame into a parallelogram shape due to external impacts from obliquely upward or lateral directions. In particular, the power supply unit 400 is positioned and fixed with respect to the sheet metal frames 210L and 210R in the front-rear and vertical directions as described above, and is fixed to the resin frames 250L and 250R with the movement in the left and right directions being limited as described above. With this configuration, deformation of the entire device frame into a parallelogram shape is reduced.

The power supply unit 400 is connected to the resin frames 250L and 250R at the end surface opposite to the projecting pieces 217 over the support legs 600, i.e., the end surface of the portion which undergoes elastic deformation as described above. Since the power supply unit 400 is connected to the resin frames 250L and 250R through the bosses 259 and the oblong holes 437L and 437R as described above, vertical deformation of the resin frames 250L and 250R with respect to the sheet metal frames 210L and 210R is allowed.

As illustrated in FIG. 8A, the resin frames 250L and 250R are wider than the sheet metal frames 210L and 210R in the left-right direction and extend further inward than the sheet metal frames 210L and 210R along the direction in which the resin frames 250L and 250R oppose each other. The support legs 600 also extend further inward than the sheet metal frames 210L and 210R. The lower surface of the power supply unit 400 opposes upper end surfaces of the inwardly extended portions of the resin frames 250L and 250R.

That is, points of action of the load of the image forming unit and external impacts on the sheet metal frames 210L and 210R from above and a point of action of upward force acting from the resin frames 250L and 250R are offset from each other along the left-right direction. When portions of the resin frames 250L and 250R extending outward from the connecting pieces 217 receive a strong impact from the vertical direction and thereby deform toward the sheet metal frames 210L and 210R, portions of the resin frames 250L and 250R extending inward abut a lower surface of a portion of the power supply unit 400 extending further inward than the sheet metal frames 210L and 210R to absorb the impact. Thus transmission of the impact to the sheet metal frames 210L and 210R can be reduced.

Preferably, a hemispherical projection 440 is provided to protrude from at least one of the inwardly extending portions of the resin frames 250L and 250R and the lower surface of the power supply unit 400 opposing to the portions, and the projection 440 abuts the opposing surface when the resin frames 250L and 250R undergo deformation.

The fixing unit 40 formed as a unit can be mounted and removed to and from the mounting sections 290L and 210R from the backside. The power supply unit 400 is disposed at a position not to interfere with mounting and removal of the fixing unit 40. As described above, since the fixing unit 40, the power supply unit 400, and the belt unit 10 are positioned by a single member, a positional relationship among the rollers 41 and 42 of the fixing unit 40, the guide 408 and the cleaner rollers 407 of the power supply unit 400, and the conveyor belt 13 of the belt unit 10 can be determined easily and accurately.

As is obvious from FIG. 3, the power supply unit 400 is disposed at a position further outside of the two connecting pieces 217 at the front and rear ends of the sheet metal frames 210L and 210R, more specifically, at a position further rearward of the rear connecting piece 217, and is fixed to the vertically-extending rear end surfaces of the sheet metal frames 210L and 210R and the resin frames 250L and 250R in a manner such that ends of the power supply unit 400 substantially adjoin the rear end surfaces of the frames. Thus the power supply unit 400 can be assembled to the sheet metal frames 210L and 210R even after the sheet metal frames 210L and 210R are mounted to be supported on the resin frames 250L and 250R.

Effects of the Present Embodiment

In the thus-configured laser printer 1 according to the present embodiment, the pair of sheet metal frames 210L and 210R which support the drum subunit 100, the exposure unit 30, the belt unit 10, and the fixing unit 40 from both lateral sides are connected to each other via the upper frame connecting units 270, 241 and 242, the under beam 244, and the frame connecting unit (the power supply unit) 400. With this configuration, relative positions of the components of the image forming unit can be maintained properly to provide accurate images with little color deviation.

The pair of sheet metal frames 210L and 210R is supported by separately provided resin frames 250L and 250R and weight of the image forming unit including the sheet metal frames 210L and 210R is received via the connecting pieces 217 on the upper surfaces of the rests 255 of the resin frames 250L and 250R. A plurality of support legs 600 provided in the resin frames 250L and 250R is positioned outward along the front-rear direction from the two connecting pieces 217 at the front and rear ends of the sheet metal frames 210L and 210R. Thus the weight of the image forming unit including the sheet metal frames 210L and 210R is received by the elasticity of the resin frames 250L and 250R between the two front and back support legs 600.

With this configuration, when the sheet metal frames 210L and 210R receives an impact from above or any one of the support legs 600 is lifted by unevenness of the installation surface, portions of the resin frames 250L and 250R extending further outside of the connecting pieces 217 in the front-rear direction elastically deform upward about the lower positions of the connecting pieces 217. The sheet metal frames 210L and 210R are less affected by influences of bending moment and torsional moment acting on the resin frames 250L and 250R. When an excessively large impact is given, deformation of the resin frames 250L and 250R are received by the lower surface of the power supply unit 400 and thus deformation or destruction of the sheet metal frames 210L and 210R can be reduced.

Even if the sheet metal frames 210L and 210R are affected by the influence of bending and torsional moment from the resin frames 250L and 250R, these influences act on the sheet metal frames 210L and 210R along the vertical direction, i.e., the plane direction. Since the sheet metal frames 210L and 210R have vertical rigidity higher than that of the extended portions of the resin frames 250L and 250R in the plane direction, positional accuracy among the components of the image forming unit, especially between the scanner unit 30 and the process units 20, can be maintained properly to provide accurate images with little color deviation.

The power supply unit 400 which is longer than the distance between the pair of sheet metal frames 210L and 210R along the left-right direction is disposed between the cutouts 216 of the sheet metal frames 210L and 210R. With this configuration, although the power supply unit 400 elongated in the left-right direction has been used as described above, an increase in size of the device can be avoided. The power supply unit 400 is fixed to the sheet metal frames 210L and 210R but is displaceable with respect to the resin frames 250L and 250R. Thus a positional relationship of the power supply unit 400 with respect to the image forming unit is defined accurately to thereby provide further accurate images.

The power supply unit 400 is fixed to, and extends between, the sheet metal frames 210L and 210R and the resin frames 250L and 250R. The power supply unit 400 is fixed to the resin frames 250L and 250R in a vertically displaceable manner. Thus the power supply unit 400 can reduce deformation of the entire device frame into a parallelogram shape due to external impacts from obliquely upward or lateral directions. Even if the resin frames 250L and 250R deform due to an impact from above, relative displacement of the power supply unit 400 and the resin frames 250L and 250R absorbs the impact.

The power supply unit 400 is fixed to an end of a sheet conveying direction by the belt, or an end in the arrangement direction of a plurality of process units 20, i.e., vertically-extending rear end surfaces of the sheet metal frames 210L and 210R and the resin frames 250L and 250R in a manner such that the ends of the power supply unit 400 substantially adjoin the rear end surfaces of the frames. Thus a large space for accommodating the image forming unit can be provided between the frame 201L and 201R for the mounting of the image forming unit without interference and deformation of the entire frame into a parallelogram shape can be reduced effectively.

Modified Embodiments

The present invention is not limited to the above-described embodiment but can be implemented in various forms without departing from the spirit and scope thereof. For example, the sheet metal frames 210L and 210R may only be placed on the resin frames 250L and 250R.

The frame connecting unit may not be an example of a power supply unit 400 but may be also an example of a unit box which accommodates the feed roller 3, the conveyor rollers 8, and the resist rollers 9. The frame connecting unit may be formed as a plate or a rod, which includes only a connecting unit without having other functions.

Although the frame connecting unit (power supply unit) 400 is fixed to the resin frames 250L and 250R in a vertically displaceable manner in the above-described embodiment, the frame connecting unit (power supply unit) 400 may alternatively be fixed to the sheet metal frames 210L and 210R in a vertically displaceable manner.

Although the oblong holes 437L and 437R are formed in each of the mounting pieces 435L and 435R of the frame connecting unit (power supply unit) 400, the oblong holes 437L and 437R may alternatively be formed in each of the resin frames 250L and 250R. Although the oblong holes 431L and 431R are formed in the mounting pieces 436 of the frame connecting unit (power supply unit) 400, the oblong holes 431L and 431R may alternatively be formed in each of the sheet metal frames 210L and 210R. The boss 259 and the screw 421 may be also provided in any of the two members to be fixed together.

The conveyor belt 13 may alternatively be an intermediate transfer belt which does not convey paper sheets. In this case, a toner image is transferred to the conveyer belt 13 from the photosensitive member and then transferred from the belt to the paper sheet.

Although the second frame of the above-described embodiment may be made of ABS resin, other resin materials which are less rigid than sheet metal may be suitably used.

The present invention may also be applied to various image forming apparatuses, including monochrome laser printers, facsimile machines and copy machines.

What is claimed is:

1. An image forming apparatus comprising:

a first right frame;

a first left frame facing the first right frame;

a second right frame positioned below the first right frame;

a second left frame facing the second right frame and positioned below the first left frame;

an image forming unit positioned between the first right frame and the first left frame; and a frame connecting unit configured to connect the first right frame, the first left frame, the second right frame and the second left frame, wherein the frame connecting unit is configured to slidably connect the first right frame and the second right frame such that one of the first right frame and the second right frame is slidable in an up-down direction relative to the other one of the first right frame and the second right frame, and the frame connecting unit is configured to slidably connect the first left frame and the second left frame such that one of the first left frame and the second left frame is slidable in the up-down direction relative to the other one of the first left frame and the second left frame.

2. The image forming apparatus according to claim 1, wherein at least one of (a) a set of the first right frame and the first left frame and (b) a set of the second right frame and the second left frame define a cutout, and the frame connecting unit is positioned at the cutout.

3. The image forming apparatus according to claim 1, further comprising a connecting member, wherein one of the second right frame and the frame connecting unit has an oblong hole extending in the up-down direction, and the connecting member is configured to pass through the oblong hole and connect the second right frame and the frame connecting unit relatively slidably to each other in the up-down direction.

4. The image forming apparatus according to claim 1, further comprising a connecting member, wherein one of the second left frame and the frame connecting unit has an oblong hole extending in the up-down direction, and the connecting member is configured to pass through the oblong hole and connect the second left frame and the frame connecting unit relatively slidably to each other in the up-down direction.

5. The image forming apparatus according to claim 3, wherein the one of the second right frame and the frame connecting unit, which has the oblong hole, is positioned between a head portion of the connecting member and the other of the second right frame and the frame connecting unit.

6. The image forming apparatus according to claim 5, wherein in a connecting portion connecting the second right frame and the frame connecting unit, a distance from the head portion to the other of the second right frame and the frame connecting unit is greater than a thickness of the one of the second right frame and the frame connecting unit, such that the second right frame and the frame connecting unit are relatively slidable to each other in the up-down direction.

7. The image forming apparatus according to claim 4, further comprising a connecting member, wherein one of the first right frame and the frame connecting unit has an oblong hole extending in a left-right direction, and the connecting member is configured to pass through the oblong hole and fix the first right frame and the frame connecting unit relatively immovably to each other in the left-right direction.

8. The image forming apparatus according to claim 1, further comprising a connecting member, wherein one of the first right frame and the frame connecting unit has a first right oblong hole extending in a left-right direction, and the connecting member is configured to pass through the first right oblong hole and fix the first right frame and the frame connecting unit relatively immovably to each other in the left-right direction, one of the first left frame and the frame connecting unit has a first left oblong hole extending in the left-right direction, and the connecting member is configured to pass through the first left oblong hole and fix the first left frame and the frame connecting unit relatively immovably to each other in the left-right direction, one of the second right frame and the frame connecting unit has a second right oblong hole extending in the up-down direction, and the connecting member is configured to pass through the second right oblong hole and connect the second right frame and the frame connecting unit relatively slidably to each other in the up-down direction, and one of the second left frame and the frame connecting unit has a second left oblong hole extending in the up-down direction, and the connecting member is configured to pass through the second left oblong hole and connect the second left frame and the frame connecting unit relatively slidably to each other in the up-down direction.

9. The image forming apparatus according to claim 1, wherein the frame connecting unit includes a power supply unit.

10. The image forming apparatus according to claim 2, wherein the frame connecting unit includes a fan configured to flow air through the cutout.

11. The image forming apparatus according to claim 1, further comprising a plurality of legs, wherein the plurality of the legs protrude from each lower surface of the second right frame and the second left frame, and a connecting portion of the first right frame and the second right frame and a connecting portion of the first left frame and the second left frame are, as viewed in a plan view, positioned on a line joining the plurality of the legs.

12. The image forming apparatus according to claim 1, further comprising:

an upper frame connecting unit configured to connect upper ends of the first right frame and the first left frame to each other; and a bottom frame connecting unit configured to connect lower ends of the second right frame and the second left frame to each other, wherein the frame connecting unit connects a connecting portion of the first right frame and the second right frame and a connecting portion of the first left frame and the second left frame by extending between the connecting portion of the first right frame and the second right frame and the connecting portion of the first left frame and the second left frame, between the upper frame connecting unit and the bottom frame connecting unit.

13. The image forming apparatus according to claim 1, wherein the first right frame and the first left frame face each other in a direction intersecting a conveying direction of a recording medium conveyed, and the frame connecting unit connects to each ends of the first right frame, the first left frame, the second right frame and the second left frame in the conveying direction.

14. The image forming apparatus according to claim 1, wherein the image forming unit includes a plurality of image forming sections arranged in a direction and parallel to one another, the first right frame, the first left frame, the second right frame and the second left frame extend in a direction parallel to the direction in which the plurality of the image forming sections are arranged, and the frame connecting unit connects to each ends, in the direction in which the plurality of the image forming sections are arranged, of the first right frame, the first left frame, the second right frame and the second left frame.

15. The image forming apparatus according to claim 1, wherein the second right frame and the second left frame are made of resin.

16. The image forming apparatus according to claim 3, wherein the connecting member includes a screw.

* * * * *